United States Patent [19]

Araki et al.

[11] Patent Number: 4,559,976

[45] Date of Patent: Dec. 24, 1985

[54] METHOD OF PREVENTING A DEFECTIVE WEFT YARN FROM BEING WOVEN IN A FABRIC IN A SHUTTLELESS LOOM

[75] Inventors: Hidejiro Araki, Toyoake; Ikuo Kodama, Toyota, both of Japan

[73] Assignee: Kabushiki Kaisha Toyoda Jidoshokki Seisakusho, Kariya, Japan

[21] Appl. No.: 533,875

[22] Filed: Sep. 20, 1983

[30] Foreign Application Priority Data

Oct. 2, 1982 [JP] Japan ..... 57-172535

[51] Int. Cl.[4] ..... D03D 47/30

[52] U.S. Cl. ..... 139/435; 139/452

[58] Field of Search ..... 139/116, 435, 1 R, 452; 242/36

[56] References Cited

U.S. PATENT DOCUMENTS

| | | | |
|---|---|---|---|
| 3,805,850 | 4/1974 | Van Duynhoven | 139/435 |
| 4,007,457 | 2/1977 | Aeppli | 242/36 |
| 4,448,223 | 5/1984 | Deborde | 139/1 E |
| 4,463,783 | 8/1984 | Suzuki | 139/1 R |

FOREIGN PATENT DOCUMENTS

| | | | |
|---|---|---|---|
| 2065726 | 11/1980 | United Kingdom | 139/1 R |

*Primary Examiner*—Henry S. Jaudon
*Assistant Examiner*—Steven Shongut
*Attorney, Agent, or Firm*—Brooks Haidt Haffner & Delahunty

[57] ABSTRACT

In a shuttleless air jet loom, a method for preventing a weft yarn having therein a defective portion, such as a too thin or too thick portion falling outside a predetermined range of limits, from being inserted into the shed and therefore woven in the fabric, is disclosed.

In normal weaving operation, the weft yarn is monitored by a weft yarn sensor which is provided in the path of the weft yarn passage, and the weaving operation of the loom is interrupted when the sensor provides a signal representing a defective portion in the yarn. The yarn thus having the defect is deflected from its normal passage when it is to be picked into the shed. After the defective weft yarn has been disposed of, the loom is reversed to a shed-opening position where restarting of the weaving operation of the loom may be effected smoothly.

9 Claims, 2 Drawing Figures

METHOD OF PREVENTING A DEFECTIVE WEFT YARN FROM BEING WOVEN IN A FABRIC IN A SHUTTLELESS LOOM

BACKGROUND OF THE INVENTION

The present invention relates to a method of preventing a weft yarn having a defect therein from being woven in a fabric in a shuttleless weaving machine such as air jet loom.

In a conventional shuttleless loom which uses fluid as the means for picking the weft yarn into the shed, it has been customarily performed that a woven fabric is inspected visually during the weaving operation of the loom for containing therein a defective weft yarn and the weaving operation is interrupted if such a faulty weft is recognized so that the weft having the fault may be removed from the fabric, whereupon the loom operation is resumed. However, since the visual inspection is made only after the defective yarn has been inserted and beaten up and therefore held firmly in the woven cloth, the removal of the defective yarn therefrom may be accomplished only by an extremely difficult and time-consuming operation during which the loom weaving operation needs be kept stopped, which will invite quite a decrease in the operational efficiency of the loom. According to another known method, a defect is recognized by detecting a yarn break resulting from such a defect and the defective weft yarn is removed for disposal thereof. In this method, however, the weft yarn containing a defect which does not result in a break thereof will be inserted through a shed and thus woven in the fabric. In this way, this method cannot cope with the problems associated with the fabric quality in that a defective weft yarn is woven in the product fabric. That is, this method is unable to avoid the deterioration of the fabric quality.

SUMMARY OF THE INVENTION

An object of the present invention is therefore to give an effective solution to the aforementioned problems by providing a method according to which a weft yarn sensor is provided which emits yarn-defect signal in response to the condition of the yarn for stopping the weaving operation of the loom.

Another object of the invention is to provide a method according to which those weft yarns which contain therein a defect such as too thin or too thick portion falling out of a predetermined range of limits are inhibited from being inserted into the warp shed, thus making possible the production of fabrics with much improved quality.

Another object of the invention is to provide a method according to which, if any defective weft yarn has already been inserted through the shed before a yarn-defect signal is emitted from the yarn sensor, the inserted weft yarn is removed with no intervention of manual operation, so that the labor is saved and the operational efficiency of the loom is improved.

In a preferred embodiment of the invention, a weft yarn is monitored by a yarn sensor which is provided in the normal passage course thereof for detecting any defective portion contained in the weft yarn, the weaving operation is interrupted when the sensor provides a yarn-defect signal in response to such a defective portion, the weft yarn having the defective portion is deflected from the course of the weft so that it may not be inserted into the shed, and then the weaving operation of the loom is resumed after the defective yarn has been thus removed.

In another embodiment of the invention, if a weft yarn having a defective portion therein has been already picked through the shed when the yarn-defect signal is emitted by a sensor, which is unlike the one in the previous embodiment adapted to detect the variation of the yarn thickness for a given length of time or of the weft, thereby stopping the weaving operation of the loom, the defective yarn is removed in an automatic manner, whereupon the loom operation is resumed.

The invention will become more readily apparent from the following description of a preferred embodiment of the method thereof which is shown by way of an example only, in the accompanying drawings, wherein:

DETAILED DESCRIPTION OF THE PREFERRED EMBODIMENT

Figure 1:
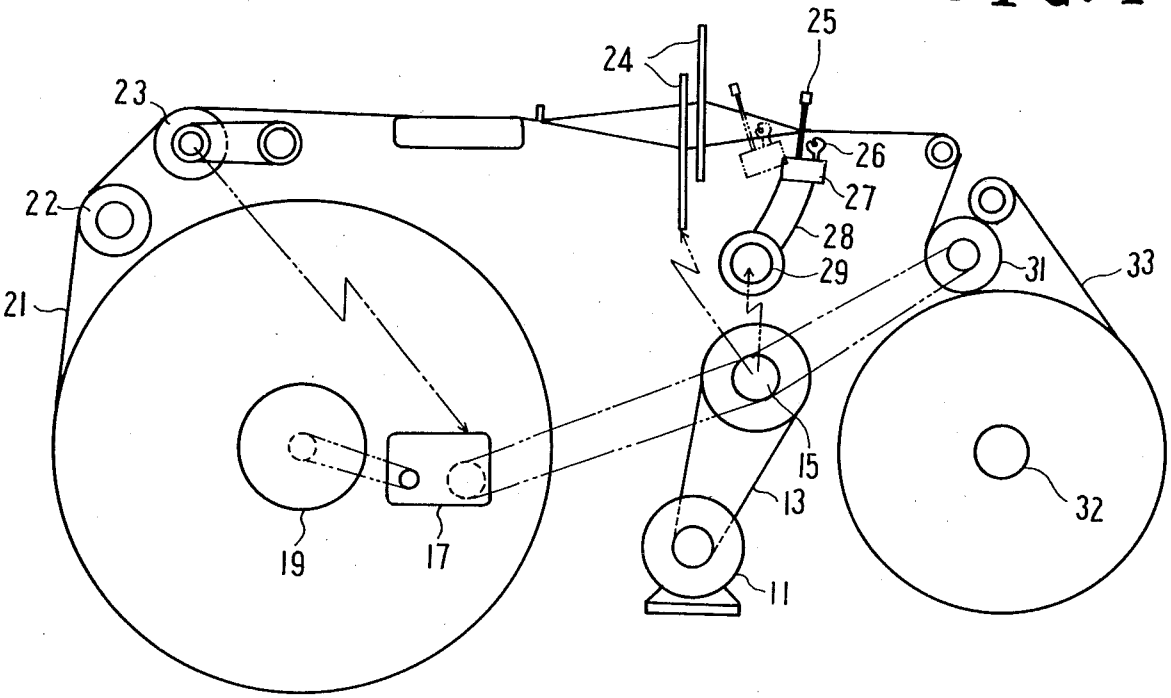
FIG. 1 is a side elevation showing a drive system for an air jet loom, as well as the weaving mechanism thereof, to which the present invention is applied.

Reference is had firstly to FIG. 1 which shows in schematic side elevation the drive system for an air jet loom. As in a conventional loom, motive power is transmitted from a main motor 11 to a crankshaft 15 of the loom through a power transmitting means such as V-belt 13. The crankshaft 15 thus driven by the main motor 11 drives in turn a yarn beam 19 via another V-belt and a speed change unit 17, thus allowing warp yarns 21 to be unwound and paid out from the yarn beam 19. The operation of the crankshaft 15 rotates a cloth beam or take-up roller 32 for winding up a woven cloth or fabric 33 therearound through still another V-belt and a frictionally-operating surface roller 31. The speed change unit 17, whose speed-change ratio may be adjusted as a function of the displacement of a tension roller 23, serves to maintain the warp yarns 21 unreeled from the yarn beam 19 through a back roller 22 at a constant tension. In addition, the rotating crankshaft 15 causes two sets of heddles 24 to move alternately up and down thereby to permit the warp yarns 21 to form sheds therebetween successively. Furthermore, the crankshaft 15 is operatively connected to a rocking shaft 29 carrying through a slay sword 28 a slay 27 to which weft guide members 26 for guiding an inserted weft yarn through the shed and a reed 25 for beating up the inserted yarn to position in the fabric 33 are secured, so that the weft guide member 26 and the reed 25 are caused to reciprocate between the beating-up position (shown by solid lines) and a filling position (shown by phantom lines).

Figure 2:
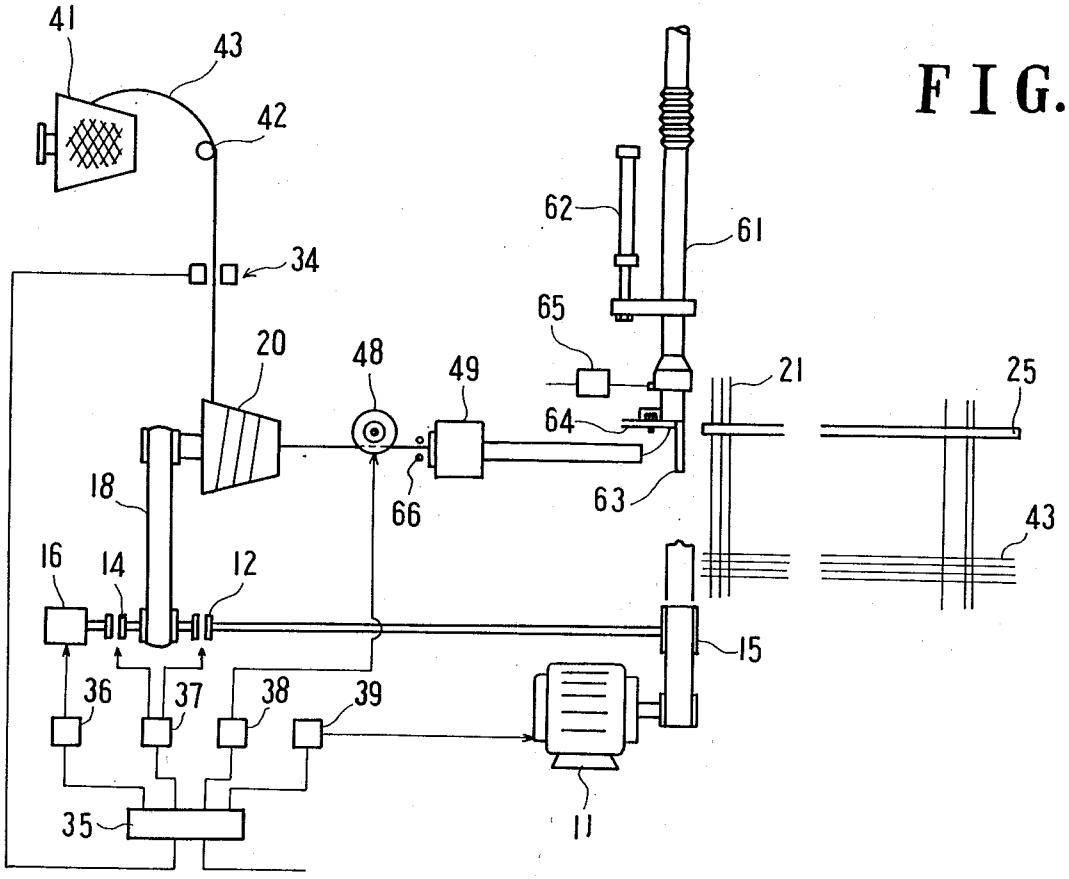
FIG. 2 is a schematic diagram showing the weft yarn inserting mechanism and its relevant arrangement which may be used in practicing the method of the invention.

Reference is made then to FIG. 2 which illustrates schematically the weft yarn inserting system in which an embodiment of the method of the invention may be carried out. A strand of weft yarn 43 which is unwound from its cheese 41 and then passed over a guide 42 is transferred to a drum 20, round which it is wound for measurement of a predetermined length thereof for one weaving cycle and where it is stored therearound temporarily.

The weft yarn storage drum 20 is connected by way of a drive belt 18 to clutches 12 and 14 of any type, electromagnetic or mechanical, the clutch 12 being connected to the crankshaft 15 which is driven by the main motor 11 and the other clutch 14 connected to an auxiliary motor 16, respectively. The auxiliary motor 16 is adapted to drive the weft storage drum 20 independently of the weaving mechanism of the loom when the clutch 12 is disengaged and the clutch 14 engaged as a result of the emission of a yarn-defect signal from a weft yarn sensor 34 which is provided in the normal course of the weft yarn passage for monitoring the condition of the weft 43. That is, the weft yarn storage drum 20 may be driven either by the main motor 11 through the crankshaft 15 or by the auxiliary motor 16 by selectively engaging the clutches 12 and 14.

In place of the above drum-type weft yarn length measuring and storage device 20, a pneumatically-operated device which combines a feed roller and a storage pipe may be employed.

As mentioned in the above, a yarn sensor 34 is provided in the course of the weft yarn passage between the guide 42 and the weft yarn storage drum 20. This weft yarn sensor 34, which is designed to detect or respond to a defect or fault contained in the weft 43, such as portion whose thickness fails to fall within a specified range of upper and lower limits, may have a structure which is similar to that of a known slub catch. That is, the sensor 34 may be of photo-electric, capacitance, or air-micro type. Furthermore, the sensor 34 may be so made that it provides a yarn-defect signal the moment a yarn defect falling outside the range of limits is detected thereby. When improvement in the loom operating efficiency is of more importance than improvement of the fabric quality, the sensor 34 may be of a type according to which it monitors the variation in the yarn thickness for any given length thereof or for any given length of time and the yarn-defect signal is generated when the integrated sum from the thickness variation for the given length exceeds a predetermined value.

On the downstream side of the weft storage drum 20 is disposed a weft yarn gripper 48 which is operated to open and close by an electromagnetic solenoid or air cylinder (not shown) for controlling the supply of a measured length of the weft yarn 43 from the storage drum 20 to an air jet nozzle 49.

A blast of compressed air is ejected from the air jet nozzle 49 in timed relation with the rotation of the crankshaft 15 to insert or impel the measured length of the weft yarn 43 into an open shed which is then formed by and between the warp yarn 21. The weft yarn 43 thus carried through the shed is beaten up by the reed 25 to the previously inserted yarn. The reference numeral 66 designates a feeler which is operated electromagnetically, mechanically, or by means of fluid.

Between the air jet nozzle 49 and a selvage of the woven fabric 33 on the side closer to the nozzle 49 is arranged an ejector-type suction tube 61, and reciprocating member 62 such as an air cylinder or an electromagnetic solenoid is connected to the suction tube 61 in such a way that the reciprocating motion of the member 62 may be imparted thereto. By the operation of the reciprocating member 62, a guide plate 63 attached to the tip end of the suction tube 61 is caused to move between its inoperative position where it is placed away from the passage of the weft yarn 43 discharged out from the air jet nozzle 49 and its operative position (shown in FIG. 2) where it lies so as to intersect the passage. In the operative position of the guide plate 63, suction is developed in the suction tube 61 and, therefore, the weft yarn which is about to enter the shed is deflected by the guide plate 63 into the tube under the influence of the suctioning effect therein. In FIG. 2, the reference numeral 64 designates a weft yarn cutter arranged adjacent to the tip end of the air jet nozzle 49 for cutting the weft yarn; and the numeral 65 a valve for controlling the air flowing into the ejector-type suction nozzle 61.

In accordance with a preferred embodiment of the invention, another yarn sensor (not shown) of photoelectric, mechanical or fluid type may be added adjacent to the fabric selvage opposite to the air jet nozzle 49 for checking the weft yarn for being inserted positively all the way through the shed.

There is provided a control box 35, to which the auxiliary motor 16, clutches 12, 14, gripper 48 and main motor 11 are connected via actuators 36, 37, 38 and 39, respectively. In response to the control signals from the control box 35, the auxiliary motor is started or stopped, the clutches 14, 12 are engaged or disengaged, the gripper 48 is set in its operative or inoperative state, and the main motor 11 is started or stopped, in the manners and for the purposes that are mentioned hereinafter.

A preferred embodiment of the method to prevent the insertion of a defective weft yarn in a shuttleless air jet loom according to the present invention will be now explained with reference to FIG. 2.

In normal weaving operation of the loom, the clutch 12 is kept in an engaged state, while the clutch 14 disengaged. Therefore, the weft yarn storage drum 20 is then driven by the main motor 11 through the crankshaft 15. Simultaneously, the crankshaft 15 driven by the main motor 11 operates on the heddles 24 so that a shed is formed successively by and between the upper and lower sheets of warp yarns 21 for receiving thereinto the weft yarn. The weft yarn 43 is fed from its cheese 41 passing over the guide 42, and then wound on the periphery of the drum 20 which is rotated in synchronism with the rotation of the crankshaft 15, thus measuring a predetermined length of the weft yarn, and simultaneously storing the same therearound temporarily. The predetermined length of the weft thus stored on the drum 20 is impelled into the shed at the moment when the gripper 48 is opened to release the same and a blast of compressed air is issued from the air jet nozzle 49, the operation of said gripper 48 and said air jet nozzle 49 being controlled closely in synchronism with the rotation of the crankshaft 15 to permit the filling operation to take place at proper timing.

If the sensor 34 which monitors the weft yarn 43 detects a yarn defect such as a too thin or too thick portion in the yarn, i.e., which fails to fall within a predetermined range of limits, it emits a yarn-defect signal. This signal is transmitted through the control box 35 to the actuator 39 to turn off the main motor 11, so that the drive system of the loom is interrupted and therefore the weaving mechanism thereof is placed under inertial operation i.e., a continued weaving operation of the loom which occurs due to inertial movement of its parts. In response to this yarn-defect signal, the actuator 36 turns on the auxiliary motor 16 and the actuator 37 disengages the clutch 12 but instead engages the clutch 14. The weft yarn gripper 48 is set in its inoperative state or kept opened. As it is now apparent, the weft yarn storage drum 20 is driven then by the auxiliary motor 16.

In addition to the above operations, the signal from the sensor 34 actuates the air cylinder or electromagnetic solenoid (not shown) to move the reciprocating member 62 forward (or downward in FIG. 2). Accordingly, the guide plate 63 attached at the tip end of the suction tube 61 is shifted to its operative position, in which position the weft yarn discharged out from the jet nozzle 49 is intercepted by the guide plate 63 and deflected into the suction tube 61 under the influence of the vacuum then created in the tube. In this way, the weft yarn 43 having therein a defective portion which is about to be picked into the shed from the air jet nozzle 49 is drawn into the suction tube 61, whereby such defective weft yarn is prevented from being inserted into the shed and woven in the fabric.

On the other hand, the weaving mechanism of the loom which is set under inertial operation with the turnoff of the main motor 11 is stopped after approximately one weaving cycle at a shed-closing position corresponding to the crank angle of about 300°.

Then reversing the main motor 11, the loom is moved through about 30° in its reverse direction to a shed-closing position corresponding to the crank angle of about 270°. Namely, this 270° position is slightly arrear of the position where the weaving mechanism of the loom had been stopped after its inertial movement, or the position which corresponds to about 300° of the crank angle stated in the above. This position (270°) is suitable for restarting the air jet loom subsequent to an interruption thereof, because the length of the weft supplied upon restarting is slightly longer than that supplied during the normal weaving operation. In this position, therefore, the weft yarn can be inserted positively through the shed, which ensures smooth restarting of the loom operation.

Though depending upon the condition of the weft yarn supplied in the form of a cheese or the like, if the weaving operation is interrupted each time a defective portion in the weft yarn is detected by the sensor 34 thereby providing a yarn-defect signal which causes the loom to be stopped, the operating efficiency may be decreased by the frequent interruptions of the loom operation. Therefore, in accordance with another embodiment of the invention, the yarn sensor 34 may be of a type which, as stated earlier, monitors the thickness variation of the weft yarn for each predetermined length thereof or of time so that it generates the yarn-defect signal only if the integrated sum from the thickness variation exceeds a predetermined value with said predetermined length.

In this embodiment, however, insertion of a weft yarn having therein a defective portion may take place before a yarn-defect signal is emitted by the sensor, with the result that the yarn is woven in the fabric. In such an event, the loom may be moved from the aforesaid stop position (or about 300° of the crank angle) through about 480° in its reverse direction to a shed-opening position (or about 180° of the crank angle) by reversing the motor 11. The defective weft yarn which has been inserted and woven in the fabric may be removed therefrom in this position of the loom in an automatic manner by using a method which is disclosed by U.S. patent application Ser. No. 512,913, filed July 12, 1983, now U.S. Pat. No. 4,502,512, whereupon the loom is turned on to bring its weaving mechanism through about 270° in its reversing direction to the shed-closing position corresponding to the crank angle of about 270° which is, as stated earlier, suitable for restarting of the air jet loom.

The weft yarn storage drum 20 continues to be driven by the auxiliary motor 16 while the weft yarn sensor 34 continues to emit a yarn-defect signal (and also during the period of time before the weaving mechanism of the air jet loom is reset under a restartable state after the emission of the yarn-defect signal is stopped), and accordingly the weft yarn fed from the drum 20 continues to be drawn into the suction tube 61. In the event that the yarn-defect signal continues to be emitted even after the weft yarn has been drawn into the suction tube 61 for a predetermined length of time, it is desirable that an operator should be called for by means of an alarm or the like for changing the cheese 41 with a new one so that the working efficiency of the loom may not be decreased due to the prolonged period of dwell time thereof.

In the above-mentioned state that is suitable for restarting of the loom, the weft yarn 43 continues to be drawn into the suction tube 61 as long as the yarn fault is detected by the sensor 34. When the fault exists no more in the weft yarn and accordingly no yarn-defect signal is available from the sensor 34, the loom readies itself automatically for a restart. Namely, the reciprocating member 62 is retracted to move the guide plate 63 away from its operative position, and the yarn cutter 64 provided adjacent to the tip end of the air jet nozzle 49 is actuated to cut off the weft yarn. Thereafter, the air jet nozzle 49 and the gripper 48 are reset in their respective normal operating states.

Though in the above-described embodiment the weft yarn storage drum 20 is selectively driven by the main motor 11 and the auxiliary motor 16 by controlling the operation of the clutches 12, 14 accordingly, the auxiliary motor 16 may be dispensed with by providing between the main motor 11 and the reed beating mechanism a clutch which is disengageable so as to shut off the transmission of power to the beating mechanism from the motor 11 which may then continue to run. In any event, operation of the beating mechanism, i.e., reed 25, is stopped so that the woven fabric 33 and warp yarns 21 will not move away from the weft insertion point while lengths of weft 43 continue to be drawn from the cheese 41, until the drawn weft 43 is no longer defective.

As it is now apparent from the foregoing, according to the method of the present invention, since the weft yarn containing therein a defective portion is removed from its normal course of passage when it is about to be picked into the shed, no defective weft yarn is woven in the fabrics, with the result that fabrics with good quality can be produced. In addition, the automatic operation in removing the defective yarn with no intervention of manual operation can contribute greatly to the improvement in operating efficiency and labor-saving in weaving operation.

While the invention has been illustrated and described with reference to preferred embodiments thereof, it is to be understood that various changes in the details may be made without departing from the spirit and scope of the invention.

We claim:

1. A method of preventing a weft yarn containing therein any defective portion from being woven into a fabric in a shuttleless loom in which consecutive lengths of weft yarn are measured as the yarn is drawn from a supply thereof and each measured length of weft yarn is inserted into the shed of warp yarns under the effect of a fluid ejected from a jet nozzle, said method comprising the steps of monitoring the drawn weft yarn by a sensor which is provided at a point between said weft yarn supply and the location where said weft yarn lengths are measured and within the path along which the weft yarn normally passes, interrupting the weaving operation of the loom in response to a yarn-defect signal which is provided by the sensor while continuing to draw said weft yarn from said supply and continuing to monitor the drawn weft yarn, removing the weft yarn having the defective portion for disposal thereof prior to the point of insertion into said shed, and restarting said weaving operation when said yarn-defect signal is terminated.

2. A method according to claim 1, wherein said removing includes deflecting the weft yarn having the defective portion at a point between the outlet of the air jet nozzle and the inlet of the shed by a movable guide member which is then positioned so as to intercept the weft yarn which is about to be inserted into the shed and a stream of fluid acting in a direction which causes the weft yarn to be deflected from the normal course thereof.

3. A method according to claim 2, further comprising the step of cutting off the weft yarn having the defective portion as said weaving operation is restarted, by a cutting means provided adjacent to the air jet nozzle.

4. A method according to claim 3, further comprising placing the loom in a shed-opened position after said weaving opration is interrupted, and said step of restarting the weaving operation of the loom is performed after the loom is placed at said shed-opened position.

5. A method according to claim 1, wherein said sensor is operated to provide the yarn-defect signal each time it detects any defective portion whose thickness falls outside a predetermined range of limits.

6. A method according to claim 5, wherein said sensor is operated to provide the yarn-defect signal when an integrated sum of the thickness variation of the weft yarn for a given length thereof exceeds a predetermined value.

7. A method according to claim 6, wherein a defective weft yarn, which has been inserted into the shed before the emission of the yarn-defect signal from the sensor is removed prior to the restarting of the weaving operation of the loom.

8. A method according to claim 5, wherein said sensor is operated to provide the yarn-defect signal when an integrated sum of the thickness variation of the weft yarn for a given length of time exceeds a predetermined value.

9. A method according to claim 8, wherein a defective weft yarn which has been inserted into the shed before the emission of the yarn-defect signal from the sensor is removed prior to the restarting of the weaving operation of the loom.

* * * * *